US007258157B2

(12) United States Patent
Damasse et al.

(10) Patent No.: US 7,258,157 B2
(45) Date of Patent: Aug. 21, 2007

(54) LATERAL FACE OF AN INSTALLATION USED FOR THE TWIN-ROLL CONTINUOUS CASTING OF METAL BANDS

(75) Inventors: Jean-Michel Damasse, Bethune (FR); Pietro Tolve, Rome (IT); Romeo Capotosti, Capitone Terni (IT); Philippe Guillo, Paris (FR)

(73) Assignees: Unisor, Puteaux (FR); Thyssenkrupp Nirosta GmbH, Krefeld (DE); Voest-Alpine Industrieanlagenbau GmbH & Co., Linz (AT)

( * ) Notice: Subject to any disclaimer, the term of this patent is extended or adjusted under 35 U.S.C. 154(b) by 0 days.

(21) Appl. No.: 10/519,750

(22) PCT Filed: Jul. 11, 2003

(86) PCT No.: PCT/FR03/02221

§ 371 (c)(1),
(2), (4) Date: Aug. 16, 2005

(87) PCT Pub. No.: WO2004/007116

PCT Pub. Date: Jan. 22, 2004

(65) Prior Publication Data

US 2006/0081352 A1 Apr. 20, 2006

(30) Foreign Application Priority Data

Jul. 12, 2002 (FR) ..... 02 08853

(51) Int. Cl.
*B22D 11/06* (2006.01)

(52) U.S. Cl. ..... 164/428; 164/480

(58) Field of Classification Search ..... 164/428, 164/480
See application file for complete search history.

(56) References Cited

U.S. PATENT DOCUMENTS

| | | | | |
|---|---|---|---|---|
| 5,172,750 | A * | 12/1992 | Birat et al. | 164/428 |
| 6,082,437 | A * | 7/2000 | Damasse et al. | 164/428 |
| 6,148,901 | A * | 11/2000 | Damasse et al. | 164/428 |
| 6,378,598 | B1 * | 4/2002 | Tonelli et al. | 164/428 |

FOREIGN PATENT DOCUMENTS

| | | | |
|---|---|---|---|
| EP | 360 635 | A1 | 3/1990 |
| EP | 901 851 | A1 | 3/1999 |
| FR | 2 785 211 | A1 | 5/2000 |
| JP | 60221155 | * | 11/1985 |

* cited by examiner

*Primary Examiner*—Kevin Kerns
*Assistant Examiner*—I.-H. Lin
(74) *Attorney, Agent, or Firm*—Sughrue Mion, PLLC

(57) ABSTRACT

The invention relates to a side wall (1) of a plant for the continuous casting of metal strip (5) between two counter-rotating rolls (2, 2') having horizontal axes and being internally cooled, the surfaces of which define a casting space confined laterally by two side walls (1) made of refractory, of the type comprising:

a support plate (6) on the front face of which a recess (7) is made;

an insert (9) made of hard material placed around the periphery of the recess (7);

a lining (11) that fills the remainder of the recess (7);

characterized in that the front face (12), turned towards the casting space, of the said lining (11) is set back by a maximum distance (d) from the front face (13) of the insert (9) over at least part of its length.

16 Claims, 2 Drawing Sheets

LATERAL FACE OF AN INSTALLATION USED FOR THE TWIN-ROLL CONTINUOUS CASTING OF METAL BANDS

This is a 371 of International Application PCT/FR03/02221 filed on Jul. 11, 2003; the entire disclosure of the prior application is hereby incorporated by reference.

The invention relates to the continuous casting of metals. It relates more particularly to plants for the continuous casting of thin metal strip of the type called "twin-roll casting", and more precisely to their refractory side walls that confine the casting space.

BACKGROUND OF THE INVENTION

Thin metal strip a few mm in thickness may be cast directly from liquid metal (steel or copper, for example) on a plant referred to as a "twin-roll casting" plant fed with liquid metal from a tundish by means of a pouring nozzle. The machine includes a mould, the casting space of which is defined along its long sides by a pair of internally cooled cylinders with parallel horizontal axes and rotating about these axes in opposite directions, and along its short sides by closure plates (called side walls) made of refractory, these being applied against the plane ends of the rolls. The liquid metal must solidify only on the cooled cylindrical surfaces of the rolls, by forming solidified shells that join up in the nip (the region where the distance between the surfaces of the rolls is a minimum) in order to form the strip, which is continuously extracted from the casting space.

In practice, it is difficult, however, always to avoid the appearance of solidification referred to as "spurious solidification", that is to say solidified metal layers that are created in certain regions of the side walls. They are due to the fact that the liquid metal neighbouring these regions may be at a temperature substantially below its nominal temperature and therefore liable to solidify locally on contact with the side walls. This low temperature may be due to unfavourable hydrodynamic conditions which do not allow the liquid metal in these regions to be sufficiently replenished, or at an insufficient temperature of the side walls due to poor preheating before casting. Of course, several of these factors may combine. When the solid metal resulting from this spurious solidification is entrained into the bottom of the casting space, it must pass between the rolls, creating a thickness of metal which is added to the normal thickness of the product. It follows that the rolls must momentarily absorb an additional load which forces them to temporarily move apart, in order to avoid damaging them. The quality of the strip is unfavourably affected thereby. It is also possible to have the side wall pushed away, with the risks of a loss of sealing of the casting space that are associated therewith.

Usually, it is attempted to limit the appearance of spurious solidification by adopting particular pouring nozzle configurations. The aim of these is to impose on the liquid metal in the casting space flow conditions that are assumed to ensure continuous replenishment of the metal facing the regions where the spurious solidification is most likely to occur, for example by bringing liquid metal leaving the nozzle directly into proximity with these regions. However, this may result in a lack of liquid metal feed in the other parts of the casting space.

Another method consists in always heating the side walls during casting, by means of burners or induction furnaces, or even also induction heating the metal lying near them. However, this results in complications in the construction of the side wall and in managing its operation.

Another method consists in varying the composition of the refractories of the side wall by placing, so as to face the casting space, fibrous refractories based on silica, alumina or other oxides having highly insulating properties. These highly insulating refractories can extract from the liquid metal only a relatively small amount of heat and thus limit the risk of spurious solidification. However, they have a low hardness and therefore withstand poorly the friction against the rolls, and also against the solidified metal or metal undergoing solidification in the vicinity of the nip. This is why, in the regions of the side wall that flank their arcs of contact with the edges of the rolls and in the regions that face the lower part of the casting space, the aforementioned insulating refractory of the inserts is substituted with a material having less insulating power but higher hardness, namely various ceramics, boron nitride, SiAlON®, etc.

However, this solution is not entirely satisfactory as heat transfer between the hard refractory and the insulating refractory occurs in their contact region, resulting in localized cooling of the insulating refractory. This may be sufficient to initiate spurious solidification.

The object of the invention is to provide a side wall designed for the twin-roll casting of thin strip that limits the appearance of spurious solidification better than the existing designs.

SUMMARY OF THE INVENTION

For this purpose, the subject of the invention is a side wall of a plant for the continuous casting of metal strip between two counter-rotating rolls having horizontal axes and being internally cooled, the surfaces of which define a casting space confined laterally by two side walls made of refractory, of the type comprising:

- a support plate on the front face of which a recess is made;
- an insert made of hard material placed around the periphery of the recess;
- a lining that fills the remainder of the recess;

characterized in that the front face, turned towards the casting space, of the said lining is set back by a maximum distance from the front face of the insert over at least part of its length.

The front face, turned towards the casting space, of the said lining may be set back from the front face of the insert over its entire length.

Preferably, over a length "$h_1$", starting from the upper edge of the recess, the lining has a constant thickness and over a length "$h_2$", the lining has a thickness that increases up to a level where the said thickness is equal to that of the insert.

The said level where the said thickness is equal to that of the insert may be the lower edge of the recess.

As a variant, the lining may have a thickness that increases from the upper edge of the recess down to the lower edge of the recess.

The distance is preferably equal to 5 mm or more.

The side wall may include an appendage over the width of the front face of the lining, the said appendage being designed to overhang the surface of the liquid metal present in the casting space.

As will have been understood, the invention essentially consists in placing the front surface of the insulating refractory lining of the side wall substantially set back with respect to the front surface of the hard refractory part, and to do so over at least the major part of the length of the lining.

BRIEF DESCRIPTION OF THE DRAWINGS

The invention will be more clearly understood on reading the description that follows, given with reference to the following appended figures.

DESCRIPTION OF THE INVENTION

Figure 1D:
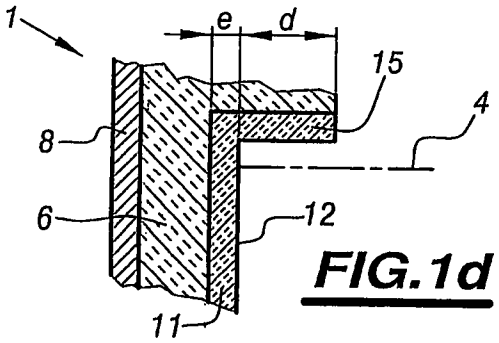
- FIG. 1*d*, which shows, in section on Id-Id, another detail of this side wall.
Figure 1C:
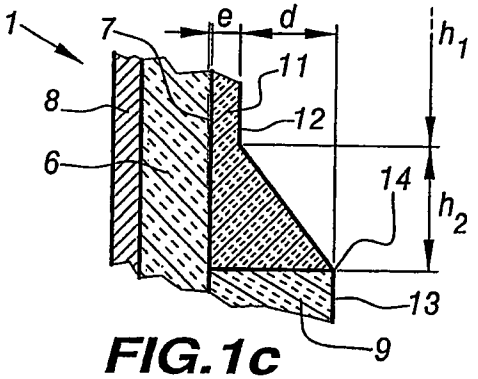
- FIG. 1*c*, which shows, in section on Ic-Ic, another detail of this side wall.
Figure 1B:
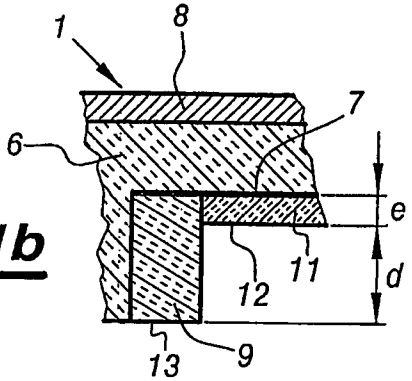
- FIG. 1*b*, which shows, seen in section on Ib-Ib, a detail of this side wall.
Figure 1A:
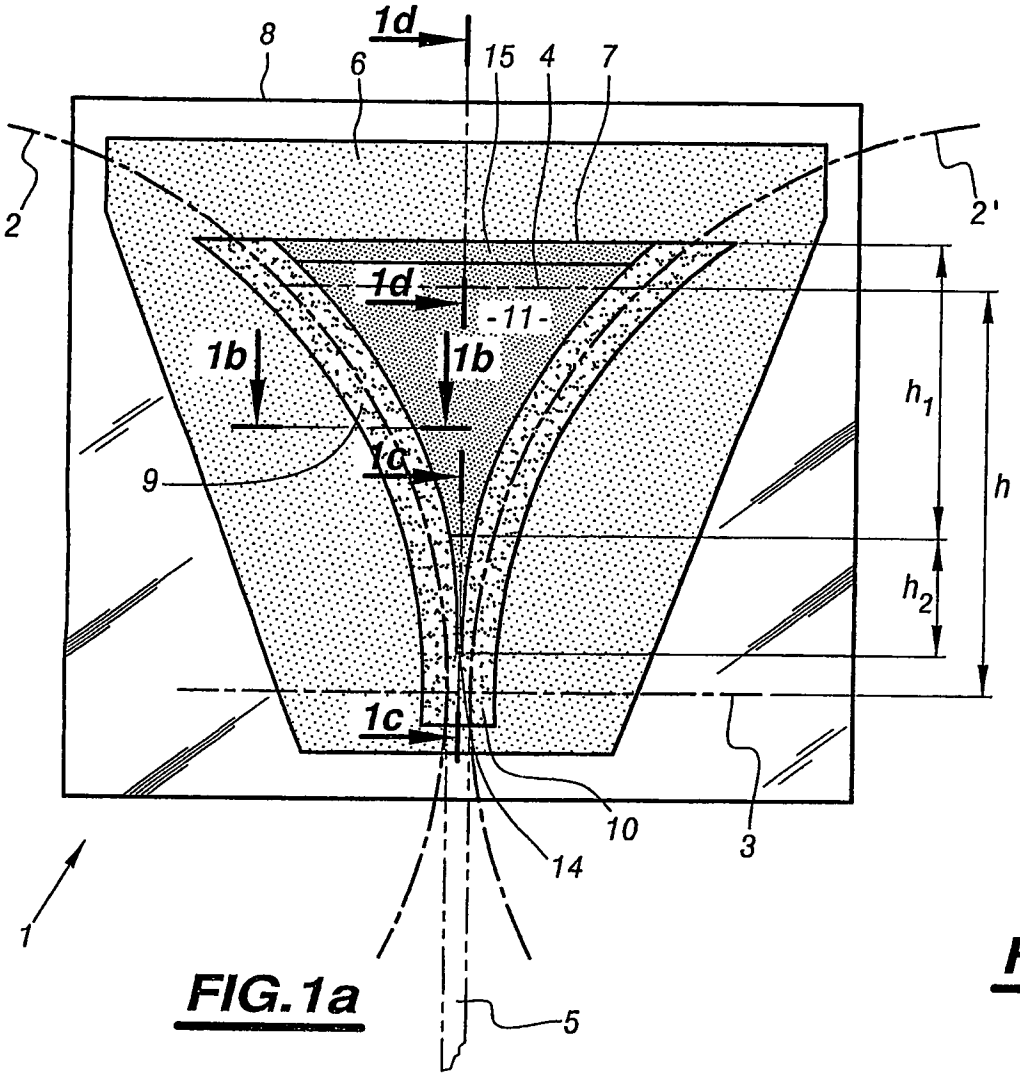
- FIG. 1*a*, which shows in a front view a first embodiment of a twin-roll continuous casting side wall according to the invention.
Figure 2D:
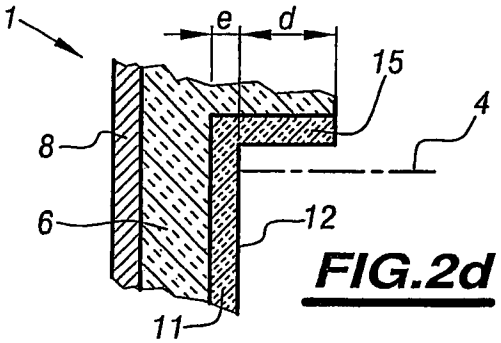
- FIGS. 2*a* to 2*d*, which shown in the same way a second embodiment of a side wall according to the invention.
Figure 2C:
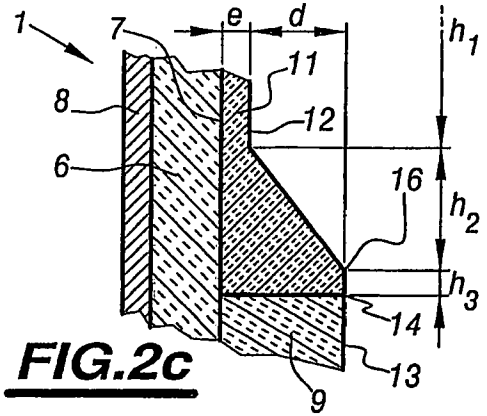
Figure 2B:
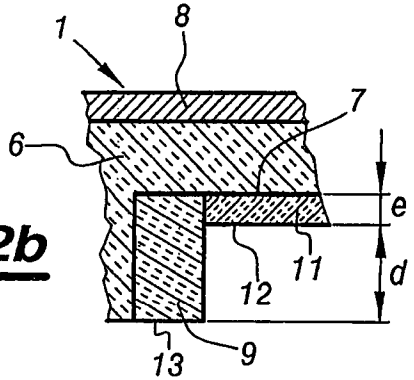
Figure 2A:
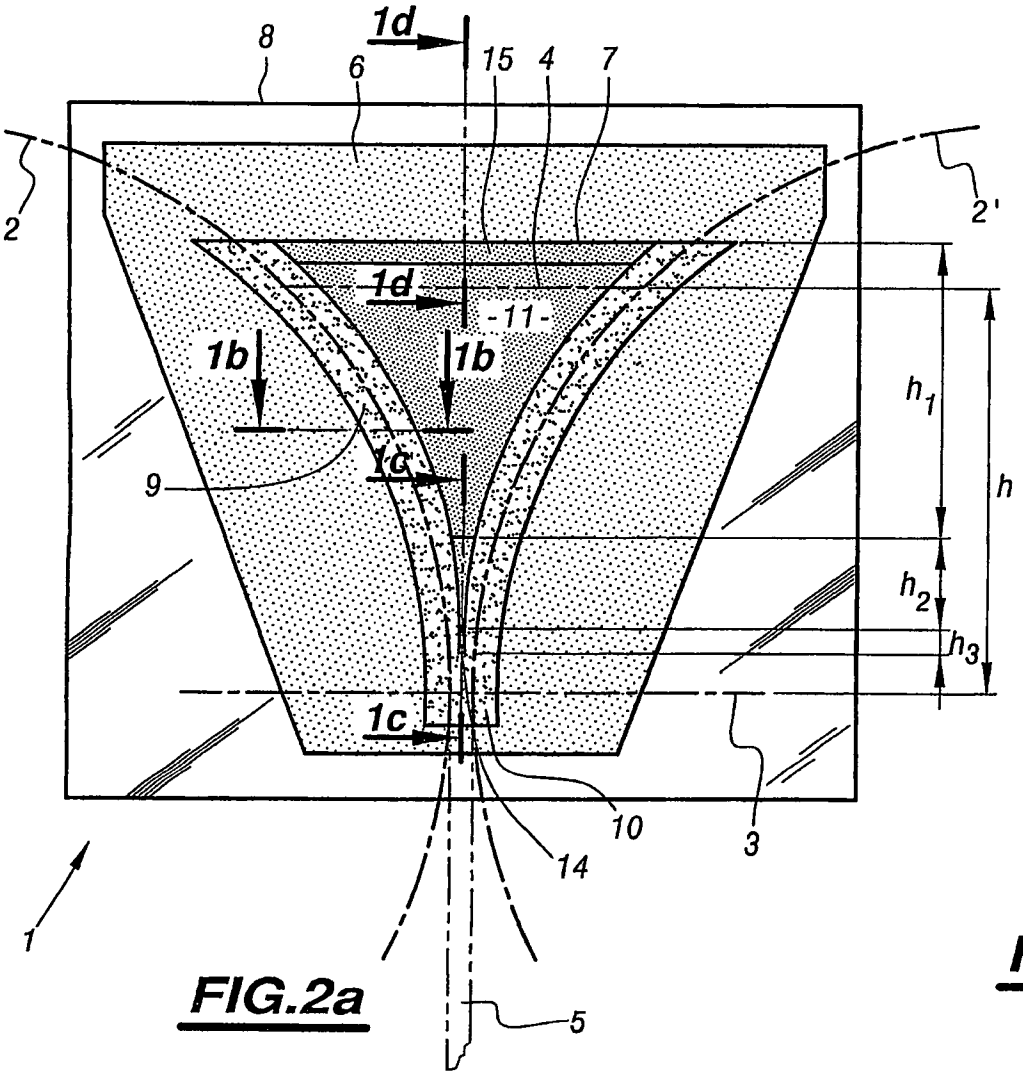

FIG. 1*a* shows schematically the front face of a first embodiment of a side wall 1 according to the invention—the dimensions are not to scale for the sake of clarity in illustrating the principle of the invention. It should be understood that, in plants capable of being used on an industrial scale for casting steel, the diameters of the rotating rolls, the outlines 2, 2' of the external surfaces of which, when the side wall 1 is in the working position, are shown by the broken lines, are from 500 to 1500 mm, while at the level 3 where the nip is located, the width of the space separating the external surfaces of the rolls is equal to the thickness of the cast strip, namely a few mm and at most 10 mm. Also shown, in dotted lines, is the nominal level 4 reached by the surface of the liquid metal present in the casting space, and also the outlines 5 of the solidified strip that is extracted from the plant. In the casting space, liquid metal is therefore likely to be found over a length "h" between the nominal level 4 of the surface of the liquid metal and the nip level 3.

The side wall 1 is composed of the following elements:

- a support plate 6 made of a refractory having highly insulating properties; on its front face, there is a recess 7; on its rear face, in the example shown, it is supported by a plate 8, the members (not shown) that apply the side wall 1 against the ends of the rolls 2 acting on the rear face of the said plate 8;
- a component 9 (which may be made of one or more parts), called an "insert" placed around the periphery of the recess 7 (except along the upper edge of the recess 7); it faces the regions surrounding the edges of the rolls and the region 10 surrounding the nip; in general, this insert 9 must face all those parts of the side wall 1 that are called upon to be in contact with the edges of the rolls and with the solidified shells in regions where sealing of the casting space is essential; in order for this sealing to be achieved permanently, despite the rubbing to which the insert 9 is subjected, it is necessary for this insert 9 to be made of a hard refractory exhibiting high resistance both to mechanical wear and to corrosion by the cast metal, such as SiAlON® or BN, even though its high density necessarily gives it relative mediocre insulating properties; and
- a lining 11 that fills the rest of the bottom of the recess 7 and therefore provides most of the contacts between the side wall 1 and the liquid metal; this lining 11 is made of a refractory having high insulating properties, such as silica foam, fibrous silica, fibrous alumina, zirconia in cast form, etc., and may have mechanical and chemical properties inferior to those of the insert 9. The insert 9 and the lining 11 constitute what may be called the "active part" of the side wall 1, in that they ensure that the liquid metal is confined between the rolls and that they provide most of the sealing of the casting space.

In the known side walls of the prior art, the front surfaces of the insert 9 and of the lining 11 lie along the precise extension of one with respect to the other. However, according to the invention, the front surface 12 of the lining 11 is substantially set back, by a maximum distance "d" from the front surface 13 of the insert 9.

Over a length "$h_1$" from the upper edge of the recess 7, the lining 11 has an approximately constant thickness "e". This means that the front surface 12 of the lining 11 is set back by a distance "d" over its entire length "$h_1$". Then, over a length "$h_2$", this thickness progressively increases so that level with the lower edge 14 of the recess 7 this thickness is equal to that of the insert 9, as may be seen in FIG. 1*c*. This figure shows a linear increase in this thickness, giving the front surface 12 of the lining 11 a plane shape in the region in question. However, other alternative forms are possible, for example an increase in the thickness of the lining 11 giving the front surface 12 a curved shape. In all cases, the presence of a portion having a length "$h_2$" over which the thickness of the lining increases, until becoming approximately equal to that of the insert 13, is at least highly recommended, if not completely essential. Otherwise, the insert 9 would present a sharp angle to the liquid metal, and there would be a risk of rapid corrosion of the upper part of the insert 9 in the region 10 surrounding the nip, and this would be unfavourable to regularity of the strip casting and solidification conditions.

The distance "d" is of the order of at least 10 mm and may be up to several tens of mm, or even several hundreds of mm (for example 250 mm), preferably from 80 to 150 mm. Typically (but not limitingly), "$h_2$" is about 1.5d so as to give the front surface 12 of the lining 11 in the region in question an average inclination of approximately 45° to the vertical.

It would not be outside the scope of the invention for the thickness of the lining 11 to increase right from the upper edge of the recess 7, in other words for "$h_1$" to be equal to 0.

Compared with the side walls of the prior art, the side wall 1 according to the invention has the following advantages.

Any spurious solidification that might occur on the lining 11 is shifted so as to be set back far from the lower part of the casting space. If the solid metal that results therefrom is entrained into the bottom of the casting space, it has more time to be remelted than in the prior art. This makes it possible to substantially reduce the risks of casting incidents due to solid metal undesirably reaching the nip level 3.

At level 4 of the upper surface of the liquid metal in the casting space, the latter has a width no longer substantially equal to that of the cast strip, but greater than it by an amount equal to twice "d". This upper surface of the liquid metal therefore has a larger area than that normally found for a given width of the cast strip. This means that the impurities (non-metallic inclusions, refractory particles torn from the side walls, etc.) which settle from the liquid metal, have a larger area to be spread over. In particular, they have a possibility of lodging near the side walls 1, in regions of width "d" not lying on the vertical of the strip undergoing solidification. The impurities therefore have relatively little chance of being re-entrained by the currents of liquid metal and so end up in the solidified strip. This gathering of the impurities near the side walls 1 may be favoured by a shape impressed on the flows in the casting space thanks to a pouring nozzle designed accordingly.

Finally, the liquid metal that comes into contact with the lining 11 in the initial stages of the casting, when the side wall 1 has not yet completely reached its definitive temperature, tends to cool more than is desirable. Thanks to the invention, this cool metal is relatively far from the strip solidification region. It therefore does not directly form the solidified strip and, before reaching the solidification region facing the rolls, it has the possibility of being reheated by the liquid metal that has not been in contact with the side walls 1. Thus, in particular at the start of casting, better regularity of the thermal conditions in the casting space is obtained.

The increase in the area of the upper surface of the liquid metal caused by the use of a side wall 1 according to the invention has the consequence of possibly increasing the radiative heat losses from the liquid metal in the casting space. However, this drawback is insignificant if, as is practically always the case, the casting space is covered by a cover that reflects the radiation back onto the metal. It is also possible, as shown in FIG. 1, for the lining 11 to have, over the width of its front face 12, an approximately horizontal appendage 15 placed just above the maximum level 4 of the liquid metal, so as to overhang it by a distance of "d" for example. This appendage 15 may also be used for resting the cover thereon, as is described in document EP-A-0 875 315 in the case of conventional side walls. In the example shown, the appendage 15 lies at the upper level of the lining 11. However, it could just as well lie somewhat lower, the essential point being that it is always above the surface of the liquid metal present in the casting space, so as to reflect the radiation that it receives back onto the liquid metal.

If it is desirable not to have too sudden a variation in the width of the casting space near the nip level 3, it is possible to use the alternative embodiment of the invention shown in FIGS. 2*a*-2*d* (elements common to the embodiment of FIG. 1 are identified by the same references). In this embodiment, there is a length $h_3$ of the lining 11 lying between the lower edge 14 of the recess 7 and a level 16 lying above the said edge 14 where the front surface 12 of the lining 11 and the front surface 13 of the insert 9 are in alignment. Depending on the requirements, this length $h_3$ may vary between a few mm and a few cm, especially depending on the possibility that there may be of avoiding the appearance of spurious solidification in this region thanks, for example, to a suitable geometry of the pouring nozzle.

As in regard to the previous embodiment, it is conceivable for "$h_1$" to be equal to 0.

The invention claimed is:

1. A side wall (1) of a plant for the continuous casting of metal strip (5) made of refractory comprising:

a support plate (6) on the front face of which a recess (7) is made;

an insert (9) made of hard material placed around the periphery of the recess (7);

a lining (11) that fills the remainder of the recess (7);

wherein the front face (12), turned towards the casting space, of the lining (11) is set back by a maximum distance (d) from the front face (13) of the insert (9) over at least part of its length.

2. The side wail (1) according to claim 1, wherein the front face (12), turned towards the casting space, of the lining (11) is set back from the front face of the insert (9) over its entire length.

3. The side wall (1) according to claim 1, wherein over a length ($h_1$), starting from an upper edge of the recess (7), the lining (11) has a constant thickness (e) and over a length ($h_2$), the lining (11) has a thickness that increases up to a level where the said thickness is equal to that of the insert (9).

4. The side wall (1) according to claim 3, wherein the said level where the said thickness is equal to that of the insert (9)15 a lower edge (14) of the recess (7).

5. The side wall (1) according to claim 1, wherein the lining (11) has a thickness that increases from an upper edge of the recess (7) down to a lower edge (14) of the recess (7).

6. The side wall (1) according to claim 1, wherein the distance (d) is equal to 10 mm or more.

7. The side wall (1) according to claim 6, wherein the distance (d) is between 80 and 150 mm.

8. The side wall (1) according to claim 1, further comprising an appendage (15) over the width of the front face (12) of the lining (11), the appendage (15) being designed to overhang the surface of the liquid metal present in the casting space.

9. An apparatus for the continuous casting of metal strip (5) comprising:

two counter-rotating rolls (2, 2') having horizontal axes; and a casting space, wherein the surfaces which define the casting space confined laterally are two side walls (1) made of refractory comprising:

a support plate (6) on the front face of which a recess (7) is made;

an insert (9) made of hard material placed around the periphery of the recess (7);

a lining (11) that fills the remainder of the recess (7);

wherein the front face (12), turned towards the casting space, of the lining (11) is set back by a maximum distance (d) from the front face (13) of the insert (9) over at least part of its length.

10. The apparatus according to claim 9, wherein the front face (12), turned towards the casting space, of the lining (11) is set back from the front face of the insert (9) over its entire length.

11. The apparatus according to claim 9, wherein over a length ($h_1$), starting from an upper edge of the recess (7), the lining (11) has a constant thickness (e) and over a length ($h_2$), the lining (11) has a thickness that increases up to a level where the said thickness is equal to that of the insert (9).

12. The apparatus according to claim 11, wherein the said level where the said thickness is equal to that of the insert (9) is a lower edge (14) of the recess (7).

13. The apparatus according to claim 9, wherein the lining (11) has a thickness that increases from an upper edge of the recess (7) down to a lower edge (14) of the recess (7).

14. The apparatus according to claim 9, wherein the distance (d) is equal to 10 mm or more.

15. The apparatus according to claim 14, wherein the distance (d) is between 80 and 150 mm.

16. The apparatus according to claim 9, wherein the side wall further comprising an appendage (15) over the width of the front face (12) of the lining (11), the appendage (15) being designed to overhang the surface of the liquid metal present in the casting space.

* * * * *

UNITED STATES PATENT AND TRADEMARK OFFICE

CERTIFICATE OF CORRECTION

PATENT NO. : 7,258,157 B2
APPLICATION NO. : 10/519750
DATED : August 21, 2007
INVENTOR(S) : Jean-Michel Damasse et al.

It is certified that error appears in the above-identified patent and that said Letters Patent is hereby corrected as shown below:

On the Title Pg
Under "Assignee" (item 73) please change the name as follows:

~~Unisor~~ Usinor

Signed and Sealed this

Seventeenth Day of March, 2009

JOHN DOLL
*Acting Director of the United States Patent and Trademark Office*